US007235308B2

(12) United States Patent
Druckrey et al.

(10) Patent No.: US 7,235,308 B2
(45) Date of Patent: Jun. 26, 2007

(54) RECYCLABLE REPULPABLE COATED PAPER STOCK

(75) Inventors: Adam Keith Druckrey, Appleton, WI (US); John MacKay Lazar, Custer, WI (US); Matthew Henry Lang, Appleton, WI (US)

(73) Assignee: Appleton Papers Inc., Appleton, WI (US)

( * ) Notice: Subject to any disclaimer, the term of this patent is extended or adjusted under 35 U.S.C. 154(b) by 63 days.

(21) Appl. No.: 10/969,859

(22) Filed: Oct. 22, 2004

(65) Prior Publication Data

US 2005/0112387 A1 May 26, 2005

Related U.S. Application Data

(60) Provisional application No. 60/516,125, filed on Oct. 31, 2003.

(51) Int. Cl.
*B32B 5/16* (2006.01)

(52) U.S. Cl. ..... 428/537.1; 428/331; 428/448; 428/514; 427/411

(58) Field of Classification Search ..... 428/537.1, 428/331, 514, 448; 427/411
See application file for complete search history.

(56) References Cited

U.S. PATENT DOCUMENTS

| | | | | |
|---|---|---|---|---|
| 2,392,972 | A | 1/1946 | Cheyney | 117/76 |
| 3,251,709 | A | 5/1966 | Bonzagni | 117/76 |
| 3,306,766 | A | 2/1967 | Hathaway et al. | 117/76 |
| 3,423,232 | A | 1/1969 | Reinhard et al. | 117/76 |
| 3,476,587 | A | 11/1969 | Demol et al. | 117/76 |
| 3,573,125 | A | 3/1971 | Elliott | 156/244 |
| 3,579,371 | A | 5/1971 | Dooley et al. | 117/76 |
| 3,707,393 | A | 12/1972 | McDonald | 117/76 |
| 3,873,345 | A | 3/1975 | Vreeland | 117/65.2 |
| 4,117,199 | A | 9/1978 | Gotoh et al. | 428/486 |
| 4,248,939 | A | 2/1981 | Parsons | 428/508 |
| 4,265,969 | A | 5/1981 | Yasuda et al. | 428/342 |
| 4,301,210 | A | 11/1981 | Yasuda et al. | 428/342 |
| 4,328,284 | A * | 5/1982 | LePoutre | 428/511 |
| 4,714,727 | A | 12/1987 | Hume, III | 524/271 |
| 4,812,550 | A * | 3/1989 | Erickson et al. | 527/201 |
| 4,844,952 | A | 7/1989 | Korenkiewicz et al. | 427/258 |
| 5,169,715 | A * | 12/1992 | Maubert et al. | 428/331 |
| 5,250,383 | A | 10/1993 | Naruse | 430/131 |
| 5,260,396 | A * | 11/1993 | Kroner et al. | 527/201 |
| 5,435,841 | A * | 7/1995 | Clungeon et al. | 106/287.25 |
| 5,654,039 | A | 8/1997 | Wenzel et al. | 427/391 |
| 5,763,100 | A | 6/1998 | Quick et al. | 428/486 |
| 5,773,131 | A | 6/1998 | Dettling | 428/201 |
| 5,837,383 | A | 11/1998 | Wenzel et al. | 428/486 |
| 5,897,411 | A | 4/1999 | Stark et al. | 428/511 |
| 5,989,724 | A | 11/1999 | Wittosch et al. | 428/511 |
| 6,548,120 | B1 | 4/2003 | Wittosch et al. | 427/411 |
| 6,803,403 | B2 * | 10/2004 | Ishihara | 524/501 |

FOREIGN PATENT DOCUMENTS

| | | |
|---|---|---|
| EP | 0 375 924 A2 | 7/1990 |
| WO | 93/25057 | 12/1993 |
| WO | 94/26513 | 11/1994 |

OTHER PUBLICATIONS

Cham- Tenero Paper Mills Inc. Receives the QA Certificate, Cham-Tenero Paper Mills.
Airflex® 100 HW Latex Coating Binder.

* cited by examiner

*Primary Examiner*—Leszek B. Kiliman
(74) *Attorney, Agent, or Firm*—Benjamin Mieliulis

(57) ABSTRACT

A coated paper stock having high moisture vapor barrier characteristics and ingredient compatible with recycling and repulping is disclosed comprising a substrate coated on at least one surface with a subcoat. The subcoat comprises a hydrolyzed amphoteric vegetable protein at at least 11 weight percent based on weight of the subcoat. A top coat is coated over said subcoat. The top coat consists essentially of a water-based dispersion of a film forming vinyl addition polymer, conjugated diene polymer or copolymer of either polymer, such as acrylic polymers, acrylic copolymers, polyvinyl acetate, polyvinyl alcohol, styrene acrylate copolymers, styrene butadiene copolymers, polyvinylidene chloride and polyvinylidene chloride copolymers. The top coat is substantially free of mineral pigments that interfere with the moisture vapor barrier characteristics. The vegetable protein is preferably a hydrolyzed amphoteric soybean protein with an average molecular weight less than 400,000 Daltons.

28 Claims, 1 Drawing Sheet

RECYCLABLE REPULPABLE COATED PAPER STOCK

This application under 35 USC § 111(a) claims benefit per 35 USC § 119(e) to application Ser. No. 60/516,125 filed Oct. 31, 2003 as a provisional application 35 USC § 111(b).

BACKGROUND OF THE INVENTION

1. Field of the Invention

This invention relates to recyclable and repulpable coated paper stocks and processes for manufacture of such coated paper stocks having high moisture vapor barrier characteristics. This invention relates to coated paper stocks having low moisture vapor transmission rates. In particular the invention relates to a coated paper stock having moisture vapor resistance and fashioned from components compatible with recycling and repulping. The moisture vapor resistant paper stock is comprised of a substrate coated on at least one surface with a subcoat and a top coat both of which are applied as water based dispersions. The water-based dispersion coating components of the invention yield a coated paper stock that is recyclable and repulpable more readily than conventional single layer extruded or laminated polyethylene coatings, and exhibits surprising vapor barrier properties.

2. Description of the Related Art

Polyethylene films extruded or laminated to paper and wax coatings coated to paper are extensively used in packaging applications to protect dry grades from moisture and provide water and grease resistance. Such coating however are generally difficult to repulp and recycle. It is desirable to find an alternate to such films and coatings that have at least some comparable barrier properties but having the added benefit of being easier to recycle and repulp.

U.S. Pat. No. 3,196,038 to Schoch et al. discloses continuous application of multiple coatings (at least three) on a paper substrate to render the paper web moisture and grease resistant. The base coating is a dispersion selected from the group consisting of polyvinyl chloride, polyvinyl acetate, polyvinylidene chloride, esters of polyacrylic acid, polystyrol, polyethylene, paraffin and mixtures thereof. The second coat, preferably of the same composition as the base coating, provides a flexible intermediate layer to which a harder top coat is then applied.

U.S. Pat. No. 3,873,345 to Vreeland discloses a process for producing a high gloss paper with a heat calendering apparatus. The coating composition taught is comprised of a mineral pigment, such as clay and a binder selected from the group consisting of vinyl acetate, styrene-isoprene and acrylic polymer latices.

U.S. Pat. No. 4,248,939 to Parsons teaches treating paper for purposes of improved printability with a first layer comprised of an inorganic pigment, such as clay, and binder, and a second layer comprised of an organic pigment and binder. The organic pigments used in the second top coat are prepared by graft copolymerizing in aqueous medium a monoethylenically unsaturated monomer onto a water soluble prepolymer. The water soluble prepolymers used include copolymers of vinyl alcohol and acrylic acid. The organic pigment coating compositions are used to create high gloss paper under less severe calendering conditions than coating systems using inorganic pigments alone.

U.S. Pat. No. 4,328,284 teaches spreading of a single layer coating composition consisting of a latex and major amounts of pigment. Only minor amounts of binder such as starch and protein are suggested for use in the composition, though no protein based composition is illustrated.

U.S. Pat. Nos. 4,265,969 and 4,301,210 to Yasuda et al. disclose processes for preparing cast coated paper having high gloss. The undercoating contains pigment binders and the aqueous overcoating consists of pigments with polymer latex binders having glass transition temperatures over 38° C.

U.S. Pat. No. 4,812,550 teaches a process for preparing grafted proteins wherein ethylenically unsaturated monomers are subjected to a free radical polymerization in an aqueous medium in the presence of solubilizing proteins. The latices thus obtainable are taught useful as binders for pigmented paper coating compositions.

U.S. Pat. No. 4,844,952 to Korenkiewicz et al. relates to multicoated substrates having stain and grease resistance. A conventional decorative finish coating composition, which is solvent based or aqueous, is applied to the substrate followed by application of a coating of a waterborne polymer composition free of external crosslinking agents.

U.S. Pat. No. 4,997,862 teaches a method of cast coating a paper described as having high gloss, flexibility, smoothness, brightness, and resistance to drum adhesion and pick resistance comprising preparing an aqueous paper coating composition of paper coating pigments and a soy protein synthetic graft copolymer adhesive binder.

U.S. Pat. No. 5,169,715 to Maubert et al. discloses a high gloss paper produced by applying two coats. The first base coat comprises a synthetic latex, starch, polyvinyl alcohol and proteins. The second gloss coating contains conventional pigments such as calcium carbonates, kaolins, talcs, calcium sulphates, silicoaluminates, satin whites, silicas, aluminas and aluminum hydroxides and binders. Acrylic styrene copolymers are used as gloss pigments.

U.S. Pat. No. 5,260,396 teaches a process for preparing a water-resistant film or coating from a water soluble or dispersible grafted protein comprising polymerizing by a free radical mechanism a mixture consisting essentially of a monoethylenically unsaturated monomer and a protein to form a grafted protein, and forming a film or coating from the grafted protein. The film is then treated or coated with di- or tri-valent salts, glyoxal or glutaraldehyde.

U.S. Pat. No. 5,435,841 teaches compositions for insolubilizing the binders in coatings for paper. This patent describes paper coating compositions as generally a fluid suspension of pigment, such as clay with or without titanium dioxide, calcium carbonate, or the like, in an aqueous medium which includes a binder, such as starch, protein, or latex, to adhere the pigment to the paper. A process for preparing an insolubilizer involving a glyoxal-urea adduct is described.

U.S. Pat. No. 5,654,039 to Wenzel teaches a recyclable and compostable paper stock comprising a primer coat of a water dispersion of a polymer selected from acrylic polymers, acrylic copolymers, polyvinyl acetate, polyvinyl alcohol, ethylene-vinyl acetate, polyethylene vinyl chloride, styrene butadiene copolymers, polyvinylidene chloride and starch. A top coat of a wax and a water dispersion of a polymer selected from acrylic polymers, acrylic copolymers, styrene-butadiene copolymers and polyvinylidene chloride is taught as forming a coated paper stock resistant to grease and having moisture barrier characteristics.

The same assignee later in U.S. Pat. Nos. 6,548,120 and 5,989,724 then asserts that the very same polymers in a base coat and top coat, this time wax free, are also recognized to have moisture barrier characterics.

Despite the above teachings, no water emulsion based moisture barrier coated papers are believed to be widely used commercially. Existing recyclable moisture barrier coated products have gained only limited acceptability.

SUMMARY OF THE INVENTION

Figure 1:
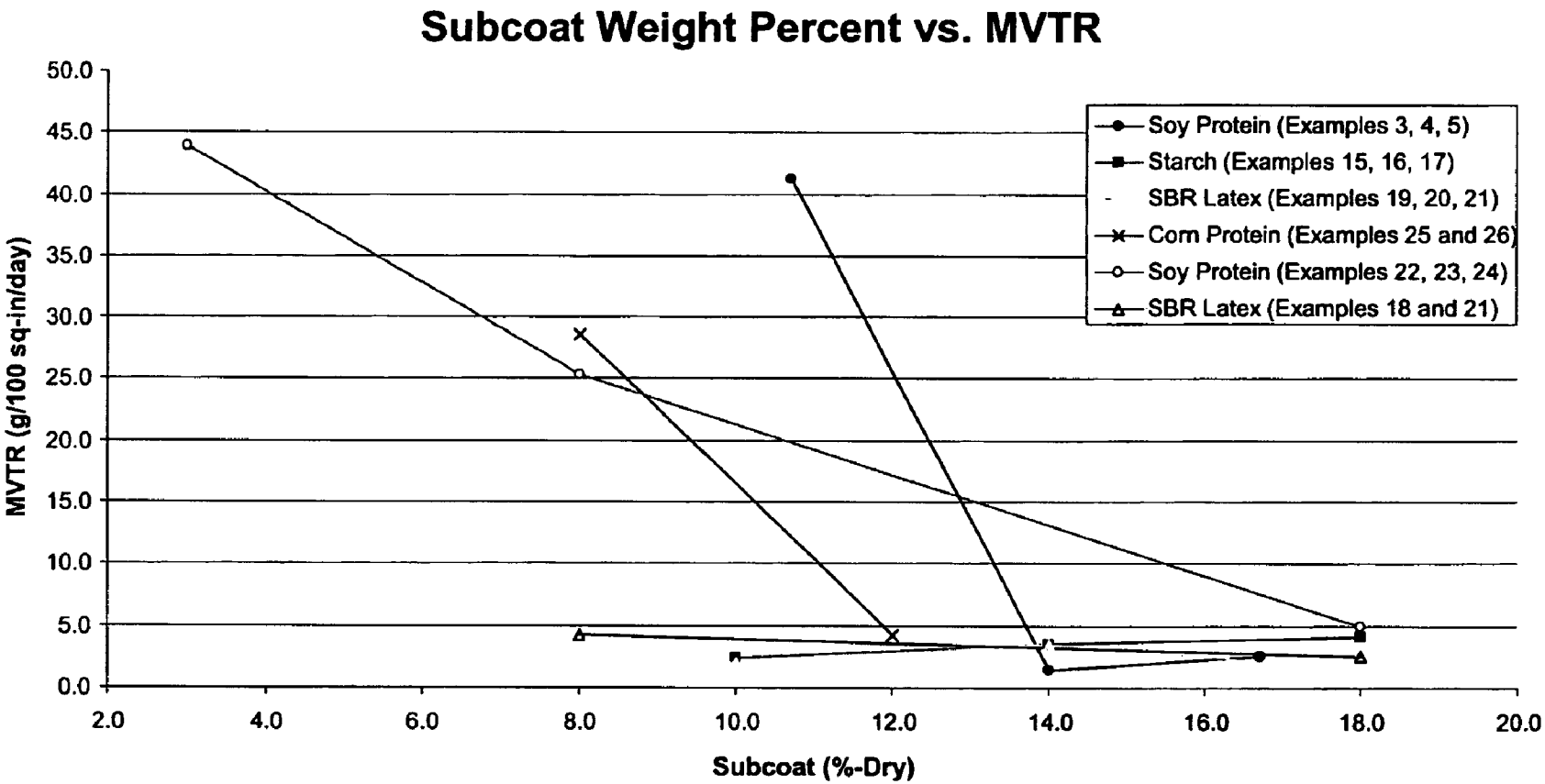
FIG. 1 illustrates MVTR results with subcoat at different concentrations.

A coated paper stock having moisture vapor barrier characteristics and ingredients compatible with recycling and repulping is disclosed. The coated paper stock comprises a substrate coated on at least one surface with a subcoat. The subcoat comprises a vegetable protein at at least 11 weight percent (wt %) based on weight of the subcoat. A top coat is applied over the subcoat. The top coat consists essentially of a water based dispersion of a film forming vinyl addition polymer, conjugated diene polymer or copolymer of either polymer.

In an alternate embodiment a coated paper stock is disclosed having moisture vapor barrier characteristics. The substrate is coated on at least one surface with a subcoat. The subcoat comprises a vegetable protein from about 11 to 100 weight percent based on weight of the subcoat. A top coat is provided over the subcoat. The top coat is substantially free of mineral pigment and comprises a water based dispersion of a film forming vinyl addition polymer, conjugated diene polymer or copolymer of either polymer.

In yet another embodiment a recyclable coated paper stock is provided based on use of ingredients compatible with typical paper recycling and pulping operations. The coated paper stock of the invention has moisture vapor barrier characteristics. The coated paper stock comprises a substrate coated on at least one surface with a subcoat. The subcoat comprises a hydrolyzed amphoteric soybean protein with an average molecular weight of less than 400,000 Daltons, at at least 11 weight percent based on weight of the subcoat. A top coat is applied over the subcoat. The top coat consists essentially of a water based dispersion of a film forming vinyl addition polymer, conjugated diene polymer or copolymer of either polymer. In any of the embodiments, optionally, a wax can be included in one or both coatings. Alternatively calcium stearate can also be included in one or both coatings.

The coated paper stock according to any of the above embodiments can further include a clay, pigment, or mineral filler in the subcoat. The coated paper stock can further include a wax in the subcoat, top coat or both coats. The subcoat weight of the coat is in the range of from 0.5 to 30 pounds per 3300 square feet of the substrate. The substrate of the coated paper stock is a cellulose based material, preferably paper, paperboard, or fiberboard.

The top coat weight of coat is in the range of from 0.5 to 30 pounds per 3300 square feet of the substrate. Preferably the vegetable protein such as soy protein is at least 14 weight percent based on weight of the subcoat. The top coat preferably comprises a polymer selected from the group consisting of acrylic polymers, acrylic copolymers, polyvinyl acetate, polyvinyl alcohol, styrene acrylate copolymers, styrene butadiene copolymers, polyvinylidene chloride, and polyvinylidene chloride copolymers. Most preferably the top coat is polyvinylidene chloride. Optionally, the coated paper stock top coat can include styrene acrylate, and/or calcium stearate.

DETAILED DESCRIPTION

The present invention discloses a recyclable coated paper stock having high moisture vapor barrier characteristics. It comprises a substrate coated on at least one surface with a subcoat, the subcoat comprises a vegetable protein of at least 1 and preferably at about 14 weight percent based on the weight of the subcoat.

Preferably the subcoat is a hydrolyzed amphoteric soybean protein of a molecular weight of less than 400,000 Daltons, and more preferably from less than 200,000 Daltons.

The subcoat is coated with at least one top coat. The top coat over the subcoat comprises a water based dispersion of a film forming vinyl addition polymer, conjugated diene polymer or copolymer of either polymer. The film forming polymers can be blends of the polymers.

The top coat is a film forming water based dispersion of a film forming polymers. The polymers can be used individually or as blends of polymers. Pigments such as mineral clays are not used in the top coat. Mineral clays open the film and do not participate in the polymer. The top coat is substantially free of mineral pigments that interfere with the moisture vapor barrier characteristics.

The preferred polymers for the top coat are acrylic polymers, acrylic copolymers, polyvinyl acetate, polyethylene vinyl chloride, styrene-butadiene copolymer, and polyvinylidene chloride and polyvinylidene chloride copolymers.

The subcoat is a vegetable protein of at least 11 and more preferably about 14 weight percent based on the weight of the subcoat. The subcoat may include waxes, pigments and clays, such as mineral clay, calcium carbonate, mica, and kaolin clay. The subcoat coat weight is in the range of 0.5 to 30 pounds per 3300 square feet. The vegetable protein comprises from 11 to 100 weight percent of the subcoat.

The presence of vegetable protein at at least 11 weight percent on a dry weight basis based on the weight of the subcoat, and more preferably at at least 14 weight percent gives rise to a dramatic and surprising change in moisture vapor transmission rates of the resulting coated papers.

The preferred vegetable protein is a soy protein. These materials are built up of a group of about 25 amino acids and derived from processing of soybeans. The protein is derived by removing the oil and hull and processing the soybean. These materials are reduced in size and extracted with an alkaline solution isolating the soy protein in its native form along with low molecular weight sugars. The protein material is hydrolyzed at high pH and reflux conditions to break the protein into smaller units. The protein is amphoteric having cationic and anionic reactive sites. The combination of hydrophobic and charged regions maintains the globular protein subunits and makes them self-associating.

The cationic sites of the protein material make the protein reactive to positively charged surfaces such as kaolin clays and pigments, and highly interactive with one another.

Hydrolization under alkaline conditions causes the protein to unfold and reassociate by hydrophobic and hydrophillic regions. Under hydrolysis conditions, hydrophillic anionic groups are more exposed reducing solution viscosity.

Optionally the soy protein can be further modified by carboxylating the protein yielding a soy protein of reduced viscosity. Such carboxylated proteins are understood and intended encompassed by the terms vegetable protein or soy protein as used herein.

Unlike synthetic polymers, the vegetable proteins are more readily degraded and recycled.

Preferred vegetable proteins herein have a specific gravity ranging from about 1.007 at a solids content in solution of 5% by weight (30° C.) to about 1.05 at 20% solids content (TAPPI TIS10104-01 Technical Information Sheet). The bulk dry specific gravity is higher. The preferred soy protein herein has a specific gravity dry of about 1.38.

The preferred vegetable protein herein is a hydrolyzed amphoteric soybean protein. This material is hydrolyzed as a 13.5% solids solution in a solution of ammonium hydroxide to yield a solution pH of about 9-10.4. Thereafter the material is acidified. The preferred hydrolyzed amphoteric soybean protein has a pH as a 15% slurry around 4.0 to 4.5.

The protein is then typically isolated and stored as a dry flake or powder. It is thereafter redispersed as hereinafter described to form the coating dispersion.

A preferred material herein is hydrolyzed amphoteric soybean protein available commercially Pro-Cote® 2560 (DuPont) CAS#72245-15-9.

Substrates useful in the invention are cellulose based materials including paper, fiberboard and paperboard, including such materials bleached or unbleached, hardwood or softwood, virgin or recycled and clay coated or uncoated. The basis weight of the substrates are in the range from 10 to 400 pounds per 3300 square feet and thicknesses in the range from 0.002 to 0.060 inches. A preferred substrate is paper selected from bleached paper, clay-coated bleached paper, unbleached paper, clay-coated unbleached paper or recycled paper.

The subcoat and top coat are applied to the substrate as aqueous slurries or dispersions, yielding a recyclable repulpable paper stock. The subcoat and top coat each have a dry coat weight on the substrate from about 0.5 to 30 pounds per 3300 square feet. Preferably, each coat weight is about 3 to 10 pounds per 3300 square feet, and most preferably around 4 to 8 pounds per 3300 square feet.

The recyclable repulpable coated paper stock of the invention desirably displays remarkable and surprising moisture barrier properties when vegetable protein as a subcoat is applied at about 11 weight percent based on the weight of the subcoat, in combination with the top coat.

The recyclable repulpable coated paper stock of the invention can be fashioned into packages or containers having moisture vapor resistance. The recyclable repulpable coated paper stock is particularly useful for packaging dry goods such as powdered milks, flours, sugars, cereals, detergents, cake mixes, grains and the like. In preferred applications, the moisture vapor barrier coating is positioned as the internal surface of the package or container. The opposite surface can be optionally further coated with conventional coatings to provide ink receptivity to add graphics to the exterior.

In the examples, and preferred embodiment, the subcoat and top coat are prepared for coating onto the substrate as water based dispersions.

For example, dispersion of the soy protein can be prepared by dissolving 16 parts in 80 parts of 66° C. water with agitation. pH is increased to about 9 to 9.5 by addition of 3 parts of a 20% solution of caustic soda to prepare a slurry. 17 parts of the protein slurry are mixed with 128 parts clay along with minor amounts of a surfactant or defoaming agent such as Surfynol™ CT111 (Air Products). The coating dispersion is coated onto a 50 pound per 3300 square feet substrate at a coat weight of 7 pounds per 3300 square feet.

The top coat is prepared by combining 89 weight percent polyvinylidene chloride (46% solids), 5 weight percent styrene acrylate (50% solids), and 6 weight percent calcium stearate (55% solids) to form a coating dispersion. The top coat is coated onto the substrate at a coat weight of 6 pounds per 3300 square feet.

Suitable coating methods include any conventionally utilized such as air knife, rod coater, blade coater, metering roll, gravure coating, curtain coating, spraying, and the like. Drying is accomplished by heated drum, or air drying, infrared drying or other conventional paper dryer.

The moisture vapor transmission rate (MVTR) can be determined by ASTM E-96 (100° F., 90% relative humidity). The coated paper of the invention yields a paper stock, using components compatible with recycling and repulping, and exhibiting MVTR of less than about 7 and more preferably of less than 2. The lower the MVTR value, the better protection the coated substrate provides from moisture gain or loss. High moisture vapor barrier characteristics for purposes hereof are understood as low MVTR values of less than 7 and preferably less than 2.

Similar procedures as the foregoing described can be used to prepare the respective weight percent of coating components used in the listed examples.

Other optional components of the subcoat and top coat may include viscosity modifiers, defoamers, antioxidants, UV inhibitors, foam control agents, release agents, anti-blocking agents and cross-linking agents.

TABLE 1

| Example | Subcoat Materials | Ctg wt % - dry | Coat Weight | Top-Coat Materials | Ctg wt % - dry | Coat weight | Moisture Vapor Transmission Rate (MVTR) (g/24 hr-100 in2) |
|---|---|---|---|---|---|---|---|
| 1 | Protein | 10.7 | 7.0 | PVDC | 100.0 | 6.0 | 47.64 |
| | clay | 89.3 | | | | | |
| 2 | Protein | 16.7 | 7.0 | PVDC | 100.0 | 6.0 | 0.48 |
| | clay | 83.3 | | | | | |
| 3 | Protein | 10.7 | 7.0 | PVDC | 95.0 | 6.0 | 41.25 |
| | clay | 89.3 | | Acrylic latex | 5.0 | | |
| 4 | Protein | 14.0 | 7.0 | PVDC | 95.0 | 6.0 | 1.47 |
| | clay | 86.0 | | Acrylic latex | 5.0 | | |
| 5 | Protein | 16.7 | 7.0 | PVDC | 95.0 | 6.0 | 2.61 |
| | clay | 83.3 | | Acrylic latex | 5.0 | | |
| 6 | Protein | 10.7 | 7.0 | PVDC | 90.0 | 6.0 | 32.26 |
| | clay | 89.3 | | Calcium stearate | 10.0 | | |

TABLE 1-continued

| Example | Subcoat Materials | Ctg wt % - dry | Coat Weight | Top-Coat Materials | Ctg wt % - dry | Coat weight | Moisture Vapor Transmission Rate (MVTR) (g/24 hr-100 in2) |
|---|---|---|---|---|---|---|---|
| 7 | Protein | 16.7 | 7.0 | PVDC | 90.0 | 6.0 | 0.91 |
| | clay | 83.3 | | Calcium stearate | 10.0 | | |
| 8 | Protein | 10.7 | 7.0 | PVDC | 90.0 | 6.0 | 50.12 |
| | clay | 89.3 | | Acrylic latex | 5.0 | | |
| | | | | Carnuba wax | 5.0 | | |
| 9 | None | | | PVDC | 100.0 | 7.0 | 21.41 |
| 10 | SBR latex | 21.0 | 7.0 | PVDC | 97.0 | 6.0 | 18.13 |
| | clay | 79.0 | | Acrylic latex | 3.0 | | |
| 11 | Protein | 14.0 | 7.0 | PVDC | 97.0 | 6.0 | 6.15 |
| | clay | 86.0 | | Acrylic latex | 3.0 | | |
| 12 | SBR latex | 21.0 | 7.0 | PVDC | 90.0 | 6.0 | 8.77 |
| | clay | 79.0 | | Calcium stearate | 5.0 | | |
| | | | | Styrene acrylate | 5.0 | | |
| 13 | Protein | 14.0 | 7.0 | PVDC | 90.0 | 6.0 | 5.99 |
| | clay | 86.0 | | Calcium stearate | 5.0 | | |
| | | | | Styrene acrylate | 5.0 | | |
| 14 | SBR latex | 21.0 | 7.0 | PVDC | 90.0 | 6.0 | 19.15 |
| | clay | 79.0 | | Clay | 10.0 | | |
| 15 | Starch | 10.0 | 6.5 | PVDC | 95.0 | 6.0 | 2.4 |
| | clay | 90.0 | | Acrylic latex | 5.0 | | |
| 16 | Starch | 14.0 | 6.5 | PVDC | 95.0 | 6.0 | 3.6 |
| | clay | 86.0 | | Acrylic latex | 5.0 | | |
| 17 | Starch | 18.0 | 6.5 | PVDC | 95.0 | 6.0 | 4.1 |
| | clay | 82.0 | | Acrylic latex | 5.0 | | |
| 18 | SBR latex | 8.0 | 6.5 | PVDC | 95.0 | 6.0 | 4.3 |
| | clay | 92.0 | | Acrylic latex | 5.0 | | |
| 19 | SBR latex | 10.0 | 6.5 | PVDC | 95.0 | 6.0 | 2.0 |
| | clay | 90.0 | | Acrylic latex | 5.0 | | |
| 20 | SBR latex | 14.0 | 6.5 | PVDC | 95.0 | 6.0 | 3.6 |
| | clay | 86.0 | | Acrylic latex | 5.0 | | |
| 21 | SBR latex | 18.0 | 6.5 | PVDC | 95.0 | 6.0 | 2.1 |
| | clay | 82.0 | | Acrylic latex | 5.0 | | |
| 22 | Soy protein clay | 3.0 | 6.5 | PVDC | 95.0 | 6.0 | 45.1 |
| | | 97.0 | | Acrylic latex | 5.0 | | |
| 23 | Soy protein clay | 8.0 | 6.5 | PVDC | 95.0 | 6.0 | 20.9 |
| | | 92.0 | | Acrylic latex | 5.0 | | |
| 24 | Soy protein clay | 18.0 | 6.5 | PVDC | 95.0 | 6.0 | 4.1 |
| | | 82.0 | | Acrylic latex | 5.0 | | |
| 25 | Corn protein clay | 8.0 | 6.5 | PVDC | 95.0 | 6.0 | 28.6 |
| | | 92.0 | | Acrylic latex | 5.0 | | |
| 26 | Corn protein clay | 12.0 | 6.5 | PVDC | 95.0 | 6.0 | 4.3 |
| | | 88.0 | | Acrylic latex | 5.0 | | |

PVDC = Lucidene 546 (Rohm & Haas)
Protein = ProCote 2560 soy protein (Dupont Soy Polymers)
Clay = Ultrawhite 90 (Englehard)
Acrylic latex = Rhoplex B-88 (Rohm & Haas)
Calcium Stearate = Calsan 55
Carnuba wax = Serfene DL-96 anionic carnuba wax (Rohm & Haas)
SBR latex = Dow 620 (Dow Chemical Co.)
Styrene acrylate = Rhoplex P-376 (Rohm & Haas)

FIG. 1. illustrates MVTR results with subcoat at different concentrations. Examples 3, 4 and 5, for instance, from Table 1 visually depicts MVTR values plotted at soy protein concentration levels of 10.7% (coating weight percent dry based on weight of the subcoat), and 14%, and 16.7%, respectively. Other subcoat materials such as styrene butadiene such as examples 19, 20 and 21 are graphed at different concentrations of styrene butadiene against respective MVTR values for comparison purposes. At around 11 weight percent vegetable protein such as corn or soy, a significant decrease in MVTR values is observed correlating to a surprising increase in moisture barrier properties.

Recyclability:

Coated paper stock using many of the coater dispersions described according to the invention was evaluated at 100% and at 10%, in a mixture with copy paper, and at two repulping levels. To simulate repulping conditions, the coated paper stock samples and copy paper were cut into 1" square pieces. 15 grams of the material was repulped in a Warring Blender at 2.5% consistency, at 60° C., for 2 and 5 minutes, on "2" speed. Two laboratory hand sheets were formed from the repulped stock. The remaining stock was screened on a 6-cut (0.006" slots) flat screen. Two hand sheets were formed from the screened accepts and a sample of the screened rejects was collected.

When similarly processed, polyethylene extruded coatings on conventional ream wrap, for example, are not reduced in size with repulping. The barrier coating on the coated paper stock according to the invention is reduced in size with repulping. Some of the coating chips pass through the screen and can be seen in the laboratory hand sheets. In a mill environment the extruded or laminated polyethylene paper coatings cause problems for recycling operations, because of their large size. The polyethylene extrudate or laminate is not reduced in size with repulping and plugs the pulper extraction plates and subsequent pumps and screens. Polyethylene extruded or laminated ream wrap is undesirable in the mixed office waste stream. Coated paper stock according to the invention similar to Example 13 was also repulped by this method. The barrier coating on the coated paper stock was reduced in size with repulping and therefore would be compatible with conventional paper mill recycling repulping operations.

The coated paper stock according to the invention was broken down into smaller pieces upon blending. The product therefore is seen to break down with repulping. The small pieces enable the product to exit the pulper without causing problems, and allow the subsequent processes to remove the coating chips.

At Appleton's West Carrollton, Ohio, facility the following evaluation of recycling coated paper stock of the type disclosed herein was reported.

Test 1—Unprinted Broke. 4200 pounds of unprinted broke was fed to a 250 ton pulper. This represents an inclusion rate of 12.5% of the total recycled pulp furnish. The load was pulped for 62 minutes before the rotor was turned off. Hand sheets from the pulper showed that the coating on the wrapper had broken down into a wide distribution of sizes, with most being 1" and smaller. A sample from the pulper was run through the Pulmac screen (0.006" slot) and hand sheets.

Test 2—Mixed Office Waste. 500 pounds of printed wrapper were fed into a 16 ton per batch pulper. This represents an inclusion rate of 1.5% of the total recycled pulp furnish. Sample was pulled from the pulper after 20 minutes and 45 minutes. Hand sheets were made from these samples. No coating chips were detected in the final pulp. It was reported that the coating was removed with low consistency screens and with reverse centrifugal cleaners, and no coating was observed later in the process. There were no reported issues from the paper machines that used the recovered pulp.

This trial demonstrated that the coated stock of the type described herein will repulp under standard conditions. The second part of the trial demonstrates that this coated paper stock fashioned into an industrial wrapper can be recycled as a mixed office waste stream.

The recyclability and repulpability of papers based on the water dispersion coating taught in this invention is further supported by the art. U.S. Pat. Nos. 5,654,039; 6,548,120 and 5,989,724 incorporated herein by reference, describe the recyclability and repulpability of papers coated with coatings formed from water dispersions of the synthetic material described therein, some aspects of which are used herein. The improvements taught herein, and particularly the vegetable protein materials used in addition, being derived from natural plant material, further enhances overall recyclability and repulpability.

All proportions and measurements are on the basis of weight and in the metric system, unless otherwise indicated.

The principles, preferred embodiments, and modes of operation of the present invention have been described in the foregoing specification of the invention which is intended to be provided to protected herein, however, is not to be construed as limited to the particular forms disclosed, since those are to be regarded as illustrative rather than restrictive. Variations and changes can be made by those skilled in the art without departing from the spirit and scope of the invention.

What is claimed is:

1. A recyclable coated paper stock having high moisture vapor barrier characteristics comprising:

a substrate coated on at least one surface with a subcoat, said subcoat comprising a hydrolyzed amphoteric vegetable protein from about 11 to 100 weight percent based on weight of the subcoat;

a top coat over said subcoat, said top coat being substantially free of mineral pigment and comprising a water based dispersion of a film forming vinyl addition polymer, conjugated diene polymer or copolymer of either polymer.

2. The coated paper stock according to claim 1 further including a clay, pigment, or mineral filler in the subcoat.

3. The coated paper stock according to claim 1 further including a wax in at least one of the top coat or subcoat.

4. The coated paper stock according to claim 1 wherein said subcoat is in the range of from 0.5 to 30 pounds per 3300 square feet of the substrate.

5. The coated paper stock according to claim 1 wherein the vegetable protein is at least 14 weight percent based on weight of the subcoat.

6. The coated paper stock according to claim 1 wherein said substrate is a cellulose based material.

7. The coated paper stock according to claim 6 wherein said substrate is paper, paperboard, or fiberboard.

8. The coated paper stock according to claim 1 wherein said top coat is in the range of from 0.5 to 30 pounds per 3300 square feet of the substrate.

9. The coated paper stock according to claim 1 wherein the top coat comprises a polymer selected from the group consisting of acrylic polymers, acrylic copolymers, polyvinyl acetate, polyvinyl alcohol, styrene acrylate copolymers, styrene butadiene copolymers, polyvinylidene chloride, and polyvinylidene chloride copolymers.

10. The coated paper stock according to claim 1 wherein the top coat is polyvinylidene chloride.

11. The coated paper stock according to claim 10 wherein the top coat includes in addition styrene acrylate.

12. The coated paper stock according to claim 11 wherein the top coat includes in addition calcium stearate.

13. The coated paper stock according to claim 1 wherein the coated paper stock has an MVTR of less than 7.

14. A recyclable coated paper stock having high moisture vapor barrier characteristics comprising:

a substrate on at least one surface with a subcoat, said subcoat comprising a hydrolyzed amphoteric soybean protein with an average molecular weight of less than 400,000 Daltons, at at least 11 weight percent based on weight of the subcoat;

a top coat over said subcoat, said top coat consisting essentially of a water based dispersion of a film forming vinyl addition polymer, conjugated diene polymer or copolymer of either polymer.

15. The coated paper stock according to claim 14 further including a clay, pigment, or mineral filler in the subcoat.

16. The coated paper stock according to claim 14 further including a wax in at least one of the top coat or subcoat.

17. The coated paper stock according to claim 13 wherein said subcoat is in the range of from 0.5 to 30 pounds per 3300 square feet of the substrate.

18. The coated paper stock according to claim 14 wherein said substrate is a cellulose based material.

19. The coated paper stock according to claim 18 wherein said substrate is paper, paperboard, or fiberboard.

20. The coated paper stock according to claim 14 wherein said top coat is in the range of from 0.5 to 30 pounds per 3300 square feet of the substrate.

21. The coated paper stock according to claim 14 wherein the soybean protein is at least 14 weight percent based on weight of the subcoat.

22. The coated paper stock according to claim 14 wherein the soybean protein is of less than 200,000 Daltons.

23. The coated paper stock according to claim 14 wherein the top coat comprises a polymer selected from the group consisting of acrylic polymers, acrylic copolymers, polyvinyl acetate, polyvinyl alcohol, polyethylene, styrene acrylate copolymers, styrene butadiene copolymers, polyvinylidene chloride, and polyvinylidene chloride copolymers.

24. The coated paper stock according to claim 14 wherein the top coat is polyvinylidene chloride.

25. The coated paper stock according to claim 24 wherein the top coat includes in addition styrene acrylate.

26. The coated paper stock according to claim 25 wherein the top coat includes in addition calcium stearate.

27. The coated paper stock according to claim 14 wherein the coated paper stock has an MVTR of less than 7.

28. A method for manufacturing a recyclable coated paper stock having high moisture vapor barrier characteristics comprising:

providing a substrate;

applying a subcoat to at least one surface of said substrate, said subcoat comprising a hydrolyzed amphoteric vegetable protein from about 11 to 100 weight percent based on weight of the subcoat;

applying a top coat over said subcoat, said top coat being substantially free of mineral pigment and comprising a water based dispersion of a film forming vinyl addition polymer, conjugated diene polymer or copolymer of either polymer;

drying said top coat to form the coated paper stock having high moisture vapor barrier characteristics.

* * * * *